US007032492B2

(12) United States Patent
Meshirer

(10) Patent No.: US 7,032,492 B2
(45) Date of Patent: Apr. 25, 2006

(54) AMMUNITION ARTICLES COMPRISING LIGHT-CURABLE MOISTURE-PREVENTATIVE SEALANT AND METHOD OF MANUFACTURING SAME

(75) Inventor: Milton S. Meshirer, 22 Law Rd., Briarcliff Manor, NY (US) 10510

(73) Assignee: Milton S. Meshirer, Briarcliff Manor, NY (US)

( * ) Notice: Subject to any disclaimer, the term of this patent is extended or adjusted under 35 U.S.C. 154(b) by 0 days.

(21) Appl. No.: 10/662,193

(22) Filed: Sep. 11, 2003

(65) Prior Publication Data

US 2005/0056183 A1 Mar. 17, 2005

(51) Int. Cl.
*F42B 5/297* (2006.01)
*F42B 5/295* (2006.01)

(52) U.S. Cl. ..... 86/43

(58) Field of Classification Search ..... 86/43
See application file for complete search history.

(56) References Cited

U.S. PATENT DOCUMENTS 3,602,143 A * 8/1971 Critcher ..... 102/449
3,650,669 A * 3/1972 Osborn et al. ..... 8/115.52
3,703,868 A * 11/1972 Braak ..... 102/293
4,071,425 A * 1/1978 Guarino et al. ..... 522/14
4,100,318 A * 7/1978 McCann et al. ..... 428/159
4,146,452 A * 3/1979 Weber et al. ..... 522/14
4,359,370 A * 11/1982 De La Mare et al. ..... 528/112
4,625,650 A * 12/1986 Bilsbury ..... 102/516
4,640,947 A 2/1987 Berg et al.
H265 H * 5/1987 Bonde et al. ..... 102/521
4,874,670 A * 10/1989 Boon et al. ..... 428/423.9
5,067,408 A * 11/1991 Martwick ..... 102/434
5,204,379 A * 4/1993 Kubota et al. ..... 522/96
5,256,203 A 10/1993 Moore et al.
H1350 H * 9/1994 Desmond et al. ..... 86/17
5,388,522 A * 2/1995 Martwick et al. ..... 102/434
5,689,084 A * 11/1997 Malotky et al. ..... 102/293
5,770,815 A 6/1998 Watson, Jr.
5,822,489 A * 10/1998 Hale ..... 385/145
6,017,973 A * 1/2000 Tamura et al. ..... 522/96
6,090,865 A * 7/2000 Dudman et al. ..... 522/16
6,179,944 B1 * 1/2001 Monolo et al. ..... 156/169
6,251,963 B1 * 6/2001 Kohler et al. ..... 522/64
6,284,813 B1 * 9/2001 Leppard et al. ..... 522/8
6,367,386 B1 * 4/2002 Brede et al. ..... 102/431
6,423,381 B1 * 7/2002 Colton et al. ..... 427/510
6,460,464 B1 10/2002 Attarwala
6,460,694 B1 10/2002 Khanna et al.
6,548,121 B1 * 4/2003 Bauer et al. ..... 427/509
6,584,909 B1 7/2003 Brede et al.
2004/0069177 A1 * 4/2004 Klein ..... 102/502

* cited by examiner

*Primary Examiner*—Michael J. Corone
*Assistant Examiner*—Bret Hayes
(74) *Attorney, Agent, or Firm*—Steven J. Hultquist; Intellectual Property/Technology Law

(57) ABSTRACT

A process for manufacturing an ammunition article, including: (a) providing a cartridge including a projectile disposed in a casing and presenting a joint between the projectile and the casing; (b) applying to the joint a sealingly effective amount of a light-curable sealant composition; and (c) exposing the applied sealant composition to curingly effective light. The resulting ammunition article is sealed at the projectile/casing joint against moisture incursion, and such article is amenable to high-speed, high-volume production by the method of the invention.

24 Claims, 1 Drawing Sheet

AMMUNITION ARTICLES COMPRISING LIGHT-CURABLE MOISTURE-PREVENTATIVE SEALANT AND METHOD OF MANUFACTURING SAME

BACKGROUND OF THE INVENTION

1. Field of the Invention

The present invention relates to ammunition articles including casing and projectile components that are sealed against penetration of moisture, e.g., atmospheric water vapor, into the seam between the casing and projectile and the interior compartment of the casing. The invention further relates to a method of manufacturing such ammunition articles, for high-volume production of such ammunition articles.

2. Description of the Related Art

In the field of munitions manufacturing, processes have been developed for high-volume production of ammunition articles including casing and projectile (bullet) components that are assembled into the final product article, with gunpowder or other explosive medium, and optionally a primer, in the interior volume of the casing.

A recurrent problem with such ammunition articles is their susceptibility to incursion of moisture, such as ambient atmosphere water vapor, at the seam between the casing and projectile components. Any such ingress of moisture is detrimental to the operation and reliability of the ammunition article, and can compromise the safety of the ammunition user.

In the manufacture of ammunition, the bullet or projectile is inserted into the open end of the casing that contains the powder charge and primer. Though the projectile is designed to fit tightly into the opening, a small gap remains at the interface between the casing and the bullet, which is susceptible to ingress of moisture, as described.

Since ammunition may be stored for long periods of time before use in a wide variety of environments, including marine and aquatic environments, and in adverse weather environments involving rain, snow or even high relative humidity conditions, a technique is required to seal the casing/projectile interface of the ammunition article at the time of its manufacture, so that the ammunition article thereafter is safeguarded against adverse moisture-containing environments that may otherwise effect moisture permeation into the interior of the casing.

The traditional technique for sealing small-caliber ammunition has been application of an asphalt-based sealant applied to the inside of the mouth of the casing before the bullet is inserted. This technique is unsatisfactory for many reasons. First, as the bullet is inserted into the casing after the application of the sealant, much of the sealant is pushed downwardly into the casing, thereby removing it from any sealing ability, so that there is a wastage of the sealant material. Second, because of the displacement of the sealant into the casing compartment by the bullet, the gap between the bullet and the casing in many instances is not fully sealed around the full circumference of the bullet at the interface with the casing, and the aforementioned moisture permeation problems remain. Third, the sealant, as an inert mass that is displaced into the portion of the casing holding the powder charge, will agglomerate the powder it contacts, thereby interfering with the desired homogeneous character and firing of the powder charge. Fourth, as the charge is ignited in subsequent use of the ammunition article, much of the sealant does not ignite and is deposited in the weapon during firing. The resulting residue interferes with the subsequent operation of the weapon using such ammunition and complicates the cleaning and maintenance of the weapon after its use. Fifth, the chlorinated solvent in which the asphalt-based sealant is dissolved has been determined to be harmful to the environment. For all these reasons, the traditional asphalt-based sealant approach is highly deficient in producing a safe, effective, and reliable moisture seal at the projectile/casing interface.

One approach designed to overcome the environmental problem is to replace the chlorinated solvent with water. This water-based sealant approach also suffers the aforementioned deficiency that much of the sealant applied to the inside of the case is pushed down into the case as the bullet is inserted during assembly, and the remaining sealant produces an irregular (and often incomplete) seal, which results in a large number of assembled ammunition articles being rejected. It also suffers the deficiency that the water-based sealant that is pushed down into the casing is mixed with the powder charge. Subsequently, when the ammunition is fired, the sealant is not entirely consumed as the powder ignites. The sealant residue is expelled into the chamber and barrel of the weapon, requiring additional cleaning of the weapon and possibly affecting the weapon's subsequent functioning. Finally, the water-based sealants used in this approach require up to 20 seconds to set, thus involving an extended processing time that is inconsistent with high-speed munitions manufacturing processes.

U.S. Pat. No. 6,367,386 issued Apr. 9, 2002 and U.S. Pat. No. 6,584,909 issued Jul. 1, 2003 disclose a method in which a capillary-active, acrylate-based anaerobic adhesive sealing agent is applied to the gap of the fully manufactured cartridge. This method is unsatisfactory for various reasons, including the fact that anaerobic adhesives behave inconsistently. They can solidify during application, resulting in the total loss of costly processing equipment. Due to differences in manufacturing equipment, processing speeds, process temperature conditions and metals, gaps between cartridges and projectiles are rarely identical. As a result of this structural variation, anaerobic adhesives do not seal with a uniform degree of adhesion. Occasionally the bond of the projectile to the cartridge is too strong, causing the weapon to explode. When relatively large gaps occur the presence of oxygen can prevent the cure of the anaerobic adhesive, resulting in an unprotected cartridge.

The foregoing discussion reflects the failure of the art to satisfactorily address and resolve the problem of sealing ammunition articles at the interface of the casing and projectile, in a manner that is amenable to high-speed manufacturing of ammunition articles, to produce consistent and reliable sealing of the casing/projectile seam, without the problems incident to prior art approaches that compromise the integrity and function of the powder charge in the cartridge, and introduce substantial weapons cleaning and maintenance issues.

It would therefore be a significant advance in the art to provide an ammunition article and manufacturing method that overcome the aforementioned deficiencies of the prior art.

SUMMARY OF THE INVENTION

The present invention relates to ammunition articles and methods of making the same, which overcome the aforementioned deficiencies of the prior art.

In one aspect, the present invention relates to a process for manufacturing an ammunition article, comprising:

(a) providing a cartridge including a projectile disposed in a casing and presenting a joint between the projectile and the casing;

(b) applying to the joint a sealingly effective amount of a light-curable sealant composition; and (c) exposing the applied sealant composition to curingly effective light.

Another aspect of the invention relates to a process for manufacturing an ammunition article including a projectile in a casing presenting a projectile/casing interface, such process including forming a light-cured sealant coating at such interface.

Yet another aspect of the invention relates to an ammunition article including a projectile mounted in a cartridge casing presenting a projectile/casing interface, with the interface sealed by a light-cured sealant composition.

Other aspects, features and embodiments of the invention will be more fully apparent from the ensuing disclosure and appended claims.

DETAILED DESCRIPTION OF THE INVENTION

Figure 1:
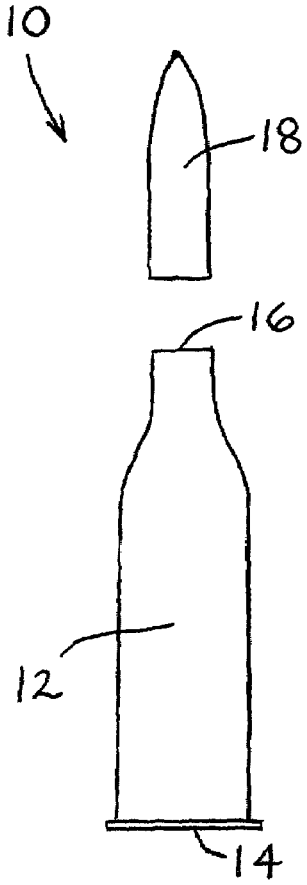
FIGS. 1–3 are schematic representations depicting successive steps in the manufacture of an ammunition article in accordance with one embodiment of the present invention.

The present invention is based on the discovery that the interface between the projectile and the casing of an ammunition article can be efficiently sealed, in a reliable and reproducible manner, by utilizing a light-curable sealant that is exteriorly applied to the joint between the projectile and casing, e.g., in a thin circumferential film of the sealant at such joint, and subsequently light-cured to produce a moisture-resistant seal. The moisture-resistant seal is effective to block moisture penetration into the interior compartment of the casing and maintain dry conditions of the powder charge and primer in the cartridge.

The exterior application of the light-curable sealant to the projectile/casing joint takes place after the projectile and casing have been assembled, i.e., mated with one another, with the projectile positioned in the casing opening.

As a result, the prior art difficulty of the squeeze-out or extruding action by the projectile (on previously applied sealant at the inner surface of the casing opening during mating engagement of the casing and projectile) is avoided in the manufacturing method of the present invention.

Further, since light-curable sealants are amenable to extremely rapid curing in exposure to curingly effective light, such as on the order of 0.01 to 0.5 second, the ammunition manufacturing method of the present invention is amenable to high-volume munitions production, enabling a production rate that has heretofore been impossible of achievement with the asphalt-based sealant and anaerobic sealant approaches of the prior art.

The light-curable sealants in accordance with the present invention can be formulated for thin film application to the projectile/casing joint of the ammunition article, so that the amount of sealant required for reliable moisture sealing of the product munitions article is minimized. Further, the sealant can be readily formulated with viscosity characteristics that prevent the capillary action of the sealant at the projectile/casing joint, and produce an optimal seal at the joint.

The manufacture of an ammunition article in accordance with the present invention involves engaging a projectile with a casing containing a charge and primer components. Such engagement is carried out to position the projectile in the opening at the distal end of the casing, and form an assembled ammunition article having a joint at the intersection of the surface bounding the distal opening of the casing and the immediately adjacent side surface of the projectile. This joint between the contacting surfaces thus forms an interface of the projectile and casing in the assembled ammunition article, and such joint extends circumferentially about the projectile and casing at their intersection.

Next, the light-curable sealant is applied to the joint around its full circumferential extent, as a bead or a band of the sealant. Any suitable application means and techniques may be employed for such purpose. For example, relative rotation may be employed between the applicator and the assembled ammunition article, such as by mounting of the assembled ammunition article for rotation on a fixture or conveyor support, and disposing the applicator in dispensing proximity to the joint of the ammunition article, so that the applicator is stationary and exudes the sealant onto the joint as the ammunition article is rotated.

Alternatively, the ammunition article may be retained in a stationary position, and the applicator may be orbited circumferentially about the ammunition article, to apply the dispensed sealant onto the joint around the full 360 arcuate extent thereof.

The applicator can be of any suitable type. Examples include, without limitation, syringe pump dispensers, roller coaters, doctor blades, and liquid-fed transfer devices such as liquid-fed brushes, sponges, swabs, pads, etc. coupled in dispensing relationship with a reservoir or supply of the liquid sealant.

In one embodiment, the applicator comprises a hypodermic-type needle dispenser, which applies a fine bead of the liquid light-curable sealant to the joint where the projectile and casing meet to form a ridge. The applicator in a further variation of this technique can also include a felt pad or other wiper element as a follower behind the hypodermic-type needle dispenser, to exert a squeegee action on the applied sealant bead so that it forms a uniformly spread sealing film over the joint, with such pad or other wiper element concurrently serving to remove any excess applied sealant.

In another embodiment, the applicator comprises a liquid sealant-saturated ring-shaped cuff that is lowered from an initial position above the upstanding ammunition article to an elevation at which the cuff surrounds the joint between the projectile and the casing, in spaced relationship to the joint. Next, a circumferential compression ring positioned at the outer periphery of the cuff is radially inwardly contracted, to press the cuff into contact against the joint, around its full 360 arcuate extent, so that liquid sealant on the cuff is transferred from the cuff to the joint.

It will be recognized that numerous configurations, arrangements and techniques are possible, as regards the applicator and the specific manner in which the liquid sealant is applied around the full 360 arcuate extent of the joint between the projectile and the casing.

During the application of the light-curable sealant to the assembled ammunition article, the ammunition article can be mounted, fixtured or supported in a suitable manner accommodating the administration of the sealant to the joint of the ammunition article, and such positioning structure may be maintained during the subsequent light-curing of the sealant, or the assembled ammunition article can alternatively be transferred to other and different mounting, fixturing, support or positioning structure to carry out the exposure of the article to the curingly effective light.

The mounting, fixturing, support or positioning device(s) for such purpose can be motive or stationary, as necessary or desirable in a given application of the invention. As an example, such device can include a conveyor belt that maintains the assembled ammunition articles in upstanding position by suitable fixtures or jigs on the belt.

Once the sealant has been applied to the joint of the assembled ammunition article, the article bearing the curable sealant at the joint is exposed to light that is curingly effective for the sealant. The light is of spectral and intensity characteristics appropriate to the light-curing of the sealant, e.g., light in the visible, ultraviolet, uv-visible, infrared, microwave or other appropriate spectral regime.

In one embodiment of the invention, the light is ultraviolet light having a wavelength in a range of from about 220 to about 375 nanometers.

The light source that is used to supply the curingly effective radiation to the sealant formulation in the practice of the invention can be of any suitable type, including lamps, LEDs, photoluminescent media, down-converting and up-converting materials that respond to incident radiation in one electromagnetic spectral regime and responsively emit radiation of a longer or shorter wavelength, respectively, electrooptical generators, lasers, etc. In instances where the sealant comprises a uv-curable resin, the source of curingly effective radiation is advantageously an ultraviolet lamp, of which numerous varieties are commercially available.

The light-curable sealant employed in the general practice of the invention can be of any suitable type. Preferably, the light-curable sealant composition is devoid of anaerobic sealing component(s).

Illustrative sealants include formulations containing a curable resin such as an unsaturated polyester, epoxy, (meth) acrylate, urethane (meth)acrylate, (meth)acrylic ester monomer, oligoester acrylate-based compound, epoxy acrylate-based compound, polyimide-based compound, aminoalkyd-based compound, vinyl ether-based compound, etc. Specific photopolymers useful in the broad practice of the present invention include: photopolymers manufactured by Ciba Specialty Chemicals, Inc. (Tarrytown, N.Y., USA) and sold by 3D Systems, Inc. (Valencia, Calif., USA) under the designations SL 7540, SL 5170, SL 5180, SL 5195, SL 5530 and SL 5510; bisphenol epichlorohydrin epoxy resins commercially available from Ciba Specialty Chemicals, Inc. (Tarrytown, N.Y.) under the trademark ARALDITE; CN- and SR-designated acrylic, urethane acrylate and acrylated polyester resins commercially available from Sartomer Co. (Exton, Pa.); and the cycloaliphatic epoxides, urethane acrylates and epoxies commercially available from Dow Chemical Co. (Midland, Mich., USA) under the CYRACURE trademark.

In general, any suitable fluid medium capable of solidification in response to the application of an appropriate form of energy stimulation may be employed in the practice of the present invention. Many liquid-phase chemicals are known that are convertible to solid-state polymeric materials by irradiation with ultraviolet light or exposure to other forms of stimulation, such as electron beams, visible or invisible light.

The light-curable sealant formulations of the invention can contain any of various suitable photopolymerization initiator species, as appropriate to the specific light-curable materials employed in the formulation. Photoinitiators useful in the broad practice of the invention include photoinitiators commercially available from Ciba Specialty Chemicals, Inc. (Tarrytown, N.Y., USA) under the trademark IRGACURE, and CYRACURE-brand photoinitiators commercially available from Dow Chemical Co. (Midland, Mich., USA).

In one exemplary aspect of the invention, photocurable resin sealant formulations are utilized that are selected from among free-radical curable acrylate resin-based formulations, and cationically curable epoxy-based formulations.

In addition to the light-curable resin(s) and photoinitator, sealant formulations of the invention can usefully comprise any other additives, adjuvants and other ingredients that benefit the formulation, application, curing and/or sealant properties of the formulation and do not preclude the utility of the formulation for its intended purpose of sealing the joint at the interface of the projectile and casing to render the joint resistant to moisture penetration into the interior of the casing. Such other ingredients may variously include, without limitation, solvents, dispersing agents, dyes, antioxidants, diluents, adhesion enhancers, viscosity-adjustment agents, fillers, extenders, etc., as well as exotic additives, such as microparticulate/nanoparticulate radio frequency identification (RFID) tags for forensic and military/police tracking of munitions, as an adjunct to conventional ballistics determinations. The sealant composition is preferably formulated so that after exposure to curingly effective light, the composition does not fluoresce.

In general, neat (solvent-free) sealant formulations are preferred, comprising photocurable resin(s) and photoinitiator, optionally with minor amounts of monomeric diluent and/or dye components. The photoinitiator may be employed at any suitable concentration. In one embodiment, the photoinitiator may be present in the sealant formulation at a concentration of less than 5% by weight, based on the total weight of the formulation. Diluent species, when present, are generally at concentrations of less than 10% by weight, based on the total weight of the sealant formulation, and dye ingredients, when present, are typically used at concentrations of less than 1% by weight, on the same total formulation weight basis, although any suitable concentrations can be employed for such diluent and dye ingredients. Dyes when used are of any suitable type, e.g., oil soluble Sudan types.

Viscosity of the sealant formulations in the broad practice of the invention can be at any suitable level consistent with effective usage of the sealant formulation. In general, the viscosity should not be so low as to allow the sealant liquid to penetrate through the projectile/casing interface into the interior casing compartment by capillary action, and the viscosity should not be so high as to make application of the sealant to the joint of the ammunition article impractical.

The choice of a given viscosity for a particular formulation may be readily made on the basis of simple experiment varying the viscosity by adjustment of the relative proportions of the ingredients of the formulation and determining the suitability of the formulation for the selected application technique, and the capillarity and sealing action of the formulation at the projectile/casing interface.

Any suitable viscosity may be employed. In one embodiment of the invention, sealant formulations are employed having formulation viscosities in a range of from about 75 to about 1000 centipoise (cps) at 25° C.

It will be recognized that the sealant in accordance with the present invention is a moisture-resistant barrier, and not a bondant or structural adhesive. Accordingly, the sealing of the interface between the casing and the projectile of the ammunition article should not significantly impede the separation of the projectile from the casing incident to the detonation of the powder charge held in the casing. This criterion can be satisfied by simple tensile testing, to determine the tensile strength that is required to separate the projectile from the casing in the absence of the sealant at the joint, and with the sealant at the joint, in corresponding comparative assembled ammunition articles, so that the variation in tensile force separation values in the respective (with and without sealant) ammunition articles does not exceed 10%, preferably being less than 5%.

Figure 2:
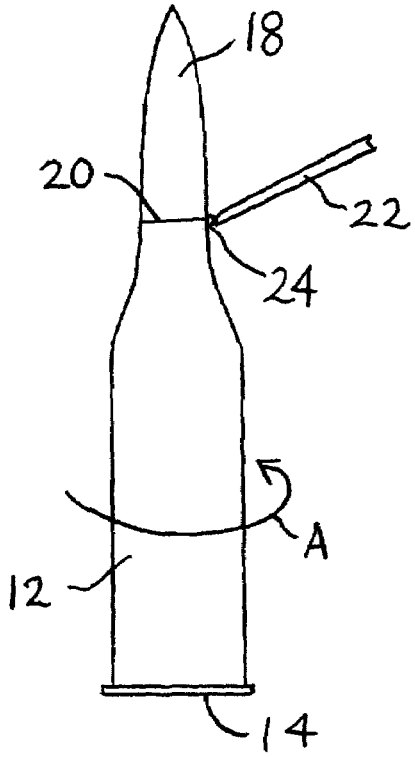
Figure 3:
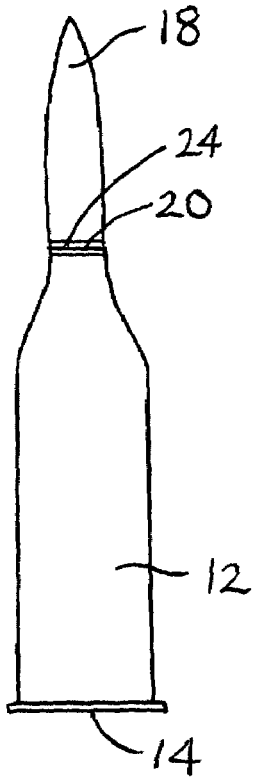

Referring now to the drawings, FIGS. 1–3 are schematic representations depicting successive steps in the manufacture of an ammunition article in accordance with one embodiment of the present invention.

FIG. 1 is an exploded view of components of an ammunition article 10, viz., casing 12 and projectile 18, in axially aligned relationship to one another. The casing 12 has a proximal flanged end portion 14 and a distal opening 16 at its upper end in the view shown. In the initial manufacturing operation, the casing is filled with the powder charge and primer components, and the projectile 18 is inserted into the distal opening 16.

Subsequent to installation of the projectile in the distal opening, the ammunition article as shown in FIG. 2 has a joint 20 between the casing 12 and the projectile 18. In this phase of manufacture, the proximal flanged end portion 14 of the ammunition article may be reposed on a suitable conveyor or support mechanism (not shown in FIG. 2) and manipulated so as to induce rotation of the ammunition article in the direction schematically indicated by arrow A. Concurrently, a hypodermic-type needle dispenser 22 is disposed with its distal tip in close but spaced proximity to the joint 20, and light-curable sealant 24 is exuded under pressure from the open tip of the needle dispenser onto the joint line extending circumferentially around the ammunition article. With the needle dispenser maintained stationarily in position, and the ammunition article being rotated in the direction indicated by arrow A, a bead of sealant is exuded onto the joint 20 through the full 360° arcuate extent of the joint line.

Subsequent to the circumferential application of the sealant to the interfacial joint 20, the ammunition article has a band of the sealant 24 overlying the joint, as depicted in FIG. 3. The ammunition article, as thus finished, may be packaged, stored, transported and ultimately used, without penetration of moisture into the joint between the casing and the projectile.

The features and advantages of the invention are more fully shown with reference to the following examples, wherein all parts and percentages are by weight, unless otherwise expressly stated.

EXAMPLE 1

Product acceptance qualification tests are utilized for determining acceptability of ammunition articles produced in accordance with the invention.

In all cases, the sealant is applied by either a brush or roll-on coating, or as a fine bead applied with a hypodermic needle. The sealant is applied at the location where the bullet and the casing meet and form a ridge. The ammunition with the applied, uncured sealant then is placed into a support system that holds it vertically as it passes under an ultraviolet light.

The ultraviolet light source is a 10-inch wide, 600 watt per linear inch, medium pressure, mercury UV lamp, manufactured by Fusion Corporation (Rockville, Md., USA). The focused light from this lamp produces a concentrated beam that is one-half inch wide on the surface of a conveyor.

The conveyor speed is set at 100 feet per minute. At this speed, each ammunition article is exposed to the beam of ultraviolet light for 0.025 second. A single pass is usually sufficient to achieve total cure of the sealant formulation.

Immediately after ultraviolet light exposure, the ammunition article is placed under water in a vacuum chamber having transparent walls. A vacuum equal to 7.5 pounds per square inch (psi) is created and the ammunition articles are carefully observed for 30 seconds. If no bubbles emerge from the ammunition cartridge, the sealant is considered as passing the immersion test.

A second test is performed to determine the holding power of the casing on the projectile of the ammunition article. As a standard, the casing must release the projectile at a force of between 45 and 200 pounds. This test is performed on an Instron® tensile tester, and the force required for separation of the projectile from the casing is tabulated in each case.

EXAMPLE 2

A first sealant formulation (Sealant A) was made up having the following composition.

| Wt. % | Ingredient |
|---|---|
| 35.0% | CN 131 low viscosity aromatic monoacrylate (Sartomer Co.) |
| 23.3% | CN 292 polyester tetraacrylate (Sartomer Co.) |
| 38.8% | CN 704 acrylated polyester (Sartomer Co.) |
| 2.9% | Irgacure 184 photoinitiator (Ciba Specialty Chemicals, Inc.) |

A second sealant formulation (Sealant B) was made up having the following composition.

| Wt. % | Ingredient |
|---|---|
| 14.6% | CN 983 urethane acrylate (Sartomer Co.) |
| 9.7% | CN 131 low viscosity aromatic monoacrylate (Sartomer Co.) |
| 14.6% | CN 704 acrylated polyester (Sartomer Co.) |
| 58.3% | SR 9209 trifunctional methacrylate (Sartomer Co.) |
| 2.9% | Irgacure 184 photoinitiator (Ciba Specialty Chemicals, Inc.) |

A third sealant formulation (Sealant C) was made up having the following composition.

| Wt. % | Ingredient |
|---|---|
| 24.3% | SR 306 tripropylene glycol diacrylate (Sartomer Co.) |
| 4.9% | CN 292 polyester tetraacrylate (Sartomer Co.) |
| 29.1% | CN 704 acrylated polyester (Sartomer Co.) |
| 38.8% | SR 9209 trifunctional methacrylate (Sartomer Co.) |
| 2.9% | Irgacure 184 photoinitiator (Ciba Specialty Chemicals, Inc.) |

A fourth sealant formulation (Sealant D) was made up having the following composition.

| Wt. % | Ingredient |
|---|---|
| 5.8% | urethane acrylate (Sartomer Co.) |
| 8.7% | CN 132 low viscosity oligomer (Sartomer Co.) |

-continued

| Wt. % | Ingredient |
|---|---|
| 42.7% | CN 704 acrylated polyester (Sartomer Co.) |
| 29.1% | SR 306 tripropylene glycol diacrylate (Sartomer Co.) |
| 10.7% | CD 560 alkoxylated hexanediol diacrylate (Sartomer Co.) |
| 2.9% | Irgacure 184 photoinitiator (Ciba Specialty Chemicals, Inc.) |

A fifth sealant formulation (Sealant E) was made up having the following composition.

| Wt. % | Ingredient |
|---|---|
| 24.3% | Araldite 6010 bisphenol epichlorohydrin epoxy resin (Ciba Specialty Chemicals, Inc.) |
| 66.9% | Cyracure 6128 cycloaliphatic epoxide resin (Dow Chemical Co.) |
| 6.1% | Tone Monomer M100 |
| 0.6% | Tint Ayd ST 8703 dye |
| 2.1% | Cyracure 6974 photoinitiator (Dow Chemical Co.) |

A sixth sealant formulation (Sealant F) was made up having the following composition.

| Wt. % | Ingredient |
|---|---|
| 10.6% | Araldite 6005 bisphenol epichlorohydrin epoxy resin (Ciba Specialty Chemicals, Inc.) |
| 86.5% | SarCat K 126 dicycloaliphatic diepoxide (Sartomer Co.) |
| 0.5% | Tint Ayd ST 8703 dye |
| 2.4% | Cyracure 6974 photoinitiator (Dow Chemical Co.) |

EXAMPLE 3

Ammunition articles are made up and sealed in accordance with the procedure of Example 1, for each of the Sealant A–F formulations of Example 2.

Each of the Sealant A–F formulation-sealed ammunition articles was then subjected to the immersion test and the Instron® tensile tester holding power test of Example 1.

Each of the Sealant A–F formulation-sealed ammunition articles passed the immersion test and the Instron® tensile tester holding power test.

While the invention has been described herein in respect of specific features, aspects and illustrative embodiments, it will be recognized that the invention is not thus limited, but rather is susceptible of implementation in modifications, variations, and other embodiments, such as will suggest themselves to those of ordinary skill in the art, based on the disclosure herein. Accordingly, the invention is intended to be broadly construed and interpreted, as encompassing all such modifications, variations, and alternative embodiments, within the spirit and scope of the claims hereafter set forth.

What is claimed is:

1. A process for manufacturing an ammunition article, comprising:

(a) providing a cartridge including a projectile disposed in a casing and presenting a joint between the projectile and the casing;

(b) applying to the joint a sealingly effective amount of a light-curable sealant composition, wherein the light-curable sealant composition (i) is not capillarily active at the joint, (ii) has a viscosity in a range from about 75 to 1000 centipoise at 25° C., and (iii) is UV-curable in exposure to ultraviolet radiation, curingly effective light therefor, within a time period of from about 0.01 to about 0.5 second, wherein a force of between 45 and 200 pounds is required to be applied to separate said projectile from said casing after cure of the light-curable sealant composition, and wherein the light-curable sealant composition is not anaerobically curing; and (c) exposing the applied sealant composition to curingly effective light comprising said UV radiation for a time period of from about 0.01 to about 0.5 second.

2. The process of claim 1, wherein applying to the joint the sealingly effective amount of the light-curable sealant composition involves relative motion of the cartridge and an applicator dispensing the light-curable sealant composition to the joint.

3. The process of claim 2, wherein the cartridge is motively translated in relation to the applicator.

4. The process of claim 2, wherein the applicator is motively translated in relation to the cartridge.

5. The process of claim 2, wherein the applicator comprises an application device selected from the group consisting of syringe pump dispensers, roller coaters, doctor blades, needle dispensers, and liquid-fed transfer devices.

6. The process of claim 2, wherein the light-curable sealant composition comprises a liquid sealant and the applicator comprises a liquid-fed transfer device selected from the group consisting of liquid-fed brushes, sponges, swabs, pads, and cuffs, coupled in dispensing relationship with a reservoir for supply of the liquid sealant.

7. The process of claim 1, wherein applying to the joint the sealingly effective amount of the light-curable sealant composition involves relative motion of the cartridge and an applicator dispensing the light-curable sealant composition to the joint, wherein the applicator comprises a needle dispenser, in combination with a wiper element as a follower behind the needle dispenser, arranged to exert a squeegee action on sealant dispensed from the needle dispenser and to remove excess applied sealant, and wherein the applied sealant composition is non-capillarily active at the joint.

8. The process of claim 1, wherein the curingly effective light comprises ultraviolet light.

9. The process of claim 8, wherein the ultraviolet light has a wavelength in a range of from about 220 to about 375 nanometers.

10. The process of claim 1, wherein the curingly effective light is supplied by a source including a light-generating component selected from the group consisting of lamps, LEDs, photoluminescent media, down-converting and up-converting materials that respond to incident radiation in one electromagnetic spectral regime and responsively emit radiation of a longer or shorter wavelength, respectively, electrooptical generators, and lasers.

11. The process of claim 1, wherein the sealant composition after exposure to a curingly effective actinic radiation, does not fluoresce.

12. The process of claim 1, wherein the light-curable sealant composition comprises a photocurable resin selected from the group consisting of unsaturated polyesters, epoxies, (meth)acrylates, urethane (meth)acrylates, (meth)acrylic ester monomers, oligoester acrylate-based compounds, epoxy acrylate-based compounds, polyimide-based compounds, aminoalkyd-based compounds, and vinyl ether-based compounds.

13. The process of claim 1, wherein the light-curable sealant composition comprises a photocurable resin selected from the group consisting of bisphenol epichiorohydrin epoxy resins, acrylic resins, urethane acrylate resins, acrylated polyester resins, and cycloaliphatic epoxides.

14. The process of claim 1, wherein the light-curable sealant composition comprises a photocurable resin and a photoinitiator therefor.

15. The process of claim 1, wherein the light-curable sealant composition comprises a formulation selected from the group consisting of free-radical curable acrylate resin-based formulations, and cationically curable epoxy-based formulations.

16. The process of claim 1, wherein the light-curable sealant composition comprises a free-radical curable acrylate resin-based formulation.

17. The process of claim 1, wherein the light-curable sealant composition comprises a catianically curable epoxy-based formulation.

18. The process of claim 1, wherein the light-curable sealant composition comprises a monomeric diluent.

19. The process of claim 1, wherein the light-curable sealant composition comprises a neat formulation of resin and photoinitiator.

20. The process of claim 1, wherein the light-curable sealant composition comprises a dye.

21. The process of claim 1, wherein the light-curable sealant composition comprises a photoinitiator in a concentration not exceeding 5% by weight, based on total weight of the composition.

22. The process of claim 1, wherein after exposure to the curingly effective light, the projectile is separable from the casing by a tensile force that is no more than 10% greater than a tensile force required to separate the projectile from the casing when the light-curable sealant composition is absent.

23. The process of claim 1, wherein after exposure to the curingly effective light, the projectile is separable from the casing by a tensile force that is no more than 5% greater than a tensile force required to separate the projectile from the casing when the light-curable sealant composition is absent.

24. An ammunition article made by the process of claim 1 including a projectile mounted in a cartridge casing presenting a projectile/casing interface, with the interface sealed by a light-cured sealant composition.

* * * * *